US008375740B2

(12) United States Patent
Yoon et al.

(10) Patent No.: US 8,375,740 B2
(45) Date of Patent: Feb. 19, 2013

(54) AIR CONDITIONER HAVING PLURAL COMPRESSORS AND PLURAL OIL SEPARATORS

(75) Inventors: Pil Hyun Yoon, Seoul (KR); Sai Kee Oh, Anyang-si (KR); Sung Oh Choi, Inchoen (KR)

(73) Assignee: LG Electronics Inc., Seoul (KR)

( * ) Notice: Subject to any disclaimer, the term of this patent is extended or adjusted under 35 U.S.C. 154(b) by 838 days.

(21) Appl. No.: 12/010,875

(22) Filed: Jan. 30, 2008

(65) Prior Publication Data

US 2009/0107170 A1 Apr. 30, 2009

(30) Foreign Application Priority Data

Oct. 25, 2007 (KR) ..... 10-2007-0107560

(51) Int. Cl.
*F25B 43/02* (2006.01)
*F25B 1/10* (2006.01)
*F25B 39/04* (2006.01)

(52) U.S. Cl. ..... 62/470; 62/468; 62/509; 62/510

(58) Field of Classification Search ..... 62/468, 62/470, 509, 510

See application file for complete search history.

(56) References Cited

U.S. PATENT DOCUMENTS

| | | | | |
|---|---|---|---|---|
| 4,586,351 | A * | 5/1986 | Igarashi et al. | 62/468 |
| 4,589,263 | A | 5/1986 | DiCarlo et al. | |
| 5,042,271 | A * | 8/1991 | Manz | 62/473 |
| 6,427,480 | B1 * | 8/2002 | Ito et al. | 62/509 |
| 2004/0065112 | A1 * | 4/2004 | Sakai et al. | 62/500 |
| 2005/0028552 | A1 * | 2/2005 | Nishijima et al. | 62/500 |
| 2006/0107686 | A1 * | 5/2006 | Jeong et al. | 62/470 |

FOREIGN PATENT DOCUMENTS

| | | | |
|---|---|---|---|
| CN | 1719035 | A | 1/2006 |
| EP | 0 715 133 | A1 | 6/1996 |
| JP | 2-196176 | A | 8/1990 |
| JP | 6-002963 | A | 1/1994 |
| JP | 2001-091068 | A | 4/2001 |
| JP | 2001-329958 | A | 11/2001 |
| KR | 10-0589655 | B1 | 6/2006 |

* cited by examiner

*Primary Examiner* — Mohammad Ali
*Assistant Examiner* — Daniel C Comings
(74) *Attorney, Agent, or Firm* — McKenna Long & Aldridge LLP

(57) ABSTRACT

An air conditioner includes a plurality of compressors, a plurality of oil separators, a plurality of oil collection pipes, a common inlet pipe, and a plurality of branch inlet pipes. The oil separators are connected to outlets of the compressors for separating a refrigerant and/or oil discharged from the compressors. The oil collection pipes are respectively connected to the oil separators for collecting oil separated by the oil separators. The common inlet pipe receives the collected oil and allows the oil to flow to the compressors. The branch inlet pipes branch off from the common inlet pipe and are respectively connected to the compressors.

5 Claims, 4 Drawing Sheets

AIR CONDITIONER HAVING PLURAL COMPRESSORS AND PLURAL OIL SEPARATORS

CROSS-REFERENCE TO RELATED APPLICATIONS

The present application claims priority under 35 U.S.C. 119 and 35 U.S.C. 365 to Korean Patent Application No. 10-2007-0107560 (filed on Oct. 25, 2007), which is hereby incorporated by reference in its entirety.

BACKGROUND

Embodiments relate to an air conditioner.

An air conditioner is a device for controlling the temperature or humidity of air using a cycle of compression, condensation, expansion, and evaporation.

In some recent air conditioners, a plurality of indoor units is connected to one or more outdoor units. In this case, the number of compressors included in the outdoor units may vary according to the capacities of the indoor units. For instance, a plurality of compressors can be included in one outdoor unit.

Oil separators can be respectively coupled to outlets of the compressors for separating oil from refrigerant discharged from the compressors. The oil separated by the oil separators is supplied to inlets of the compressors through oil collection pipes.

Oil collected from one compressor is supplied to the same compressor and is not supplied to the other compressors. Thus, the compressors can have unbalanced oil level, and components of a compressor having insufficient oil can lead to mechanical abrasion.

SUMMARY

Embodiments provide an air conditioner in which oil levels of compressors are balanced so that the compressors can be prevented from being damaged due to insufficient oil.

In one embodiment, an air conditioner includes: a plurality of compressors; a plurality of oil separators connected to outlets of the compressors for separating refrigerant and/or oil discharged from the compressors; a plurality of oil collection pipes respectively connected to the oil separators for collecting oil separated by the oil separators; a common inlet pipe for receiving oil separated by the oil separators and allowing the oil to flow to the compressors; and a plurality of branch inlet pipes branching off from the common inlet pipe and respectively connected to the compressors.

In another embodiment, an air conditioner includes: a plurality of compressors; a common inlet pipe through which refrigerant flows to the compressors; branch inlet pipes branching off from the common inlet pipe and connected to the compressors; a plurality of oil separators connected to outlets of the compressors for separating oil from the refrigerant discharged from the compressors; and an oil collection unit connected to the common inlet pipe for allowing oil separated by the oil separators to flow to the common inlet pipe.

In a further embodiment, an air conditioner includes: a plurality of compressors; a common inlet pipe through which refrigerant flows to the compressors; branch inlet pipes branching off from the common inlet pipe and connected to the compressors; an accumulator connected to the common inlet pipe for allowing a gas portion of the refrigerant to move to the common inlet pipe; a plurality of oil separators connected to outlets of the compressors for separating oil from the refrigerant discharged from the compressors; and an oil collection unit through which oil separated by the oil separators flows, the oil collection unit being connected to the common inlet pipe.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
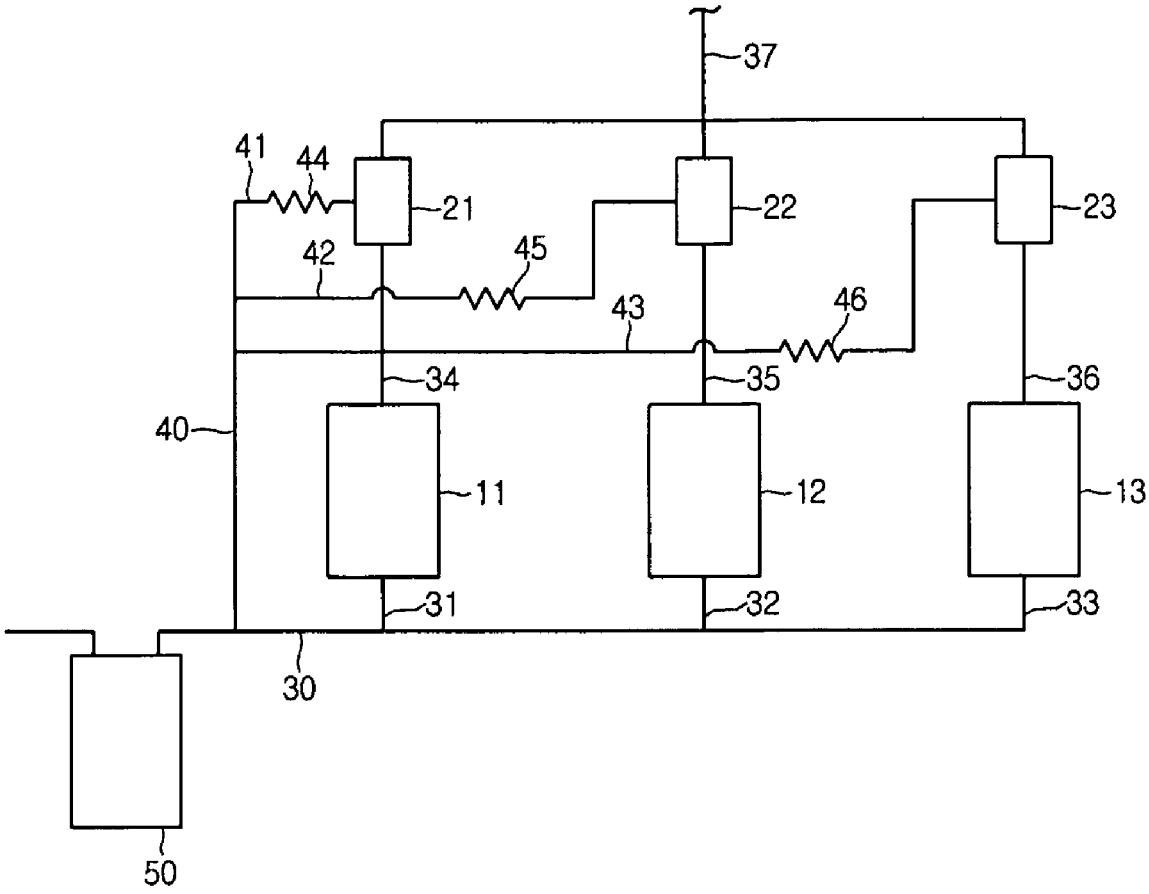
FIG. 1 is a partial refrigerant cycle diagram of an air conditioner according to a first embodiment.

FIG. 1 is a partial refrigerant cycle diagram of an air conditioner according to a first embodiment.

Referring to FIG. 1, the air conditioner of this embodiment includes a plurality of compressors such as first, second, and third compressors 11, 12, and 13 that are disposed in parallel. Although three compressors are shown in FIG. 1, the number of compressors can vary.

The capacities of the compressors 11, 12, and 13 can vary. Furthermore, various types of compressors can be used for the compressors 11, 12, and 13. For example, an inverter compressor having a variable rotation speed or a constant speed compressor can be used.

An inlet pipe unit is connected to the compressors 11, 12, and 13 to supply refrigerant from an evaporator (not shown) to the compressors 11, 12, and 13 through an accumulator 50. The inlet pipe unit may include a common inlet pipe 30 and a plurality of branch inlet pipes 31, 32, and 33. The branch inlet pipes 31, 32, and 33 branch off from the common inlet pipe 30 and are connected to the compressors 11, 12, and 13, respectively.

The evaporator discharges refrigerant which is received by the common inlet pipe 30 and is distributed to the branch inlet pipes 31, 32, and 33, and then supplied to the compressors 11, 12, and 13.

Branch outlet pipes 34, 35, and 36 are respectively connected to the compressors 11, 12, and 13 for carrying refrigerant and/or oil discharged from the compressors 11, 12, and 13. A common outlet pipe 37 is commonly connected to the branch outlet pipes 34, 35, and 36.

Therefore, streams of refrigerant discharged from the compressors 11, 12, and 13 flow along the branch outlet pipes 34, 35, and 36, and then gather at the common outlet pipe 37. Thereafter, the refrigerant moves to a condenser (not shown).

First to third oil separators 21, 22, and 23 are disposed at the branch outlet pipes 34, 35, and 36 to separate oil from refrigerant discharged from the compressors 11, 12, and 13.

An oil collection unit is connected to the oil separators 21, 22, and 23 to supply the oil separated by the oil separators 21, 22, and 23 back to the compressors 11, 12, and 13.

The oil collection unit may include branch oil collection pipes 41, 42, and 43 and a common oil collection pipe 40. The branch oil collection pipes 41, 42, and 43 are connected to the respective oil separators 21, 22, and 23. The common oil collection pipe 40 is connected between the common inlet pipe 30 and the branch oil collection pipes 41, 42, and 43 for gathering streams of oil coming from the branch oil collection pipes 41, 42, and 43 and supplying the gathered oil to the common inlet pipe 30.

Therefore, oil separated by the oil separators 21, 22, and 23 flows through the branch oil collection pipes 41, 42, and 43, and streams of the oil gather at the common oil collection pipe 40. Then, the gathered oil is supplied to the common inlet pipe 30.

First to third capillaries 44, 45, and 46 may be disposed at the respective branch oil collection pipes 41, 42, and 43 for reducing the pressure of oil flowing through the branch oil collection pipes 41, 42, and 43.

The capillaries 44, 45, and 46 may have different diameters according to the capacities of the compressors 11, 12, and 13. For instance, a large-capacity compressor may discharge large amounts of refrigerant and oil, and thus an oil separator having a large separating rate may be necessary.

In this case, the amount of oil separated by the oil separator may be large. Accordingly, a capillary having a large diameter may be necessary.

Therefore, for example, when the first compressor 11 has a capacity larger than those of the second compressor 12 and the third compressor 13, the diameter of the first capillary 44 may be larger than those of the second and third capillaries 45 and 46.

An exemplary operation of the air conditioner will now be described. In the following description, it is assumed that the first compressor 11 has the largest capacity, and the second compressor 12 has a capacity larger than that of the third compressor 13.

When the compressors 11, 12, and 13 operate, refrigerant is introduced into the compressors 11, 12, and 13. Then, the refrigerant is discharged from the compressors 11, 12, and 13 to the branch outlet pipes 34, 35, and 36 together with oil. The discharged refrigerant and oil are separated from each other by the oil separators 21, 22, and 23.

Here, the amounts of refrigerant and oil discharged from the first compressor 11 may be largest, and thus, the amount of oil separated by the first oil separator 21 may be largest.

The separated oil is discharged from the oil separators 21, 22, and 23 to the branch oil collection pipes 41, 42, and 43. However, some oil not separated from the refrigerant at the oil separators 21, 22, and 23 may be discharged from the oil separators 21, 22, and 23 to the common outlet pipe 37 together with the refrigerant. The oil and refrigerant flow from the common outlet pipe 37 to the accumulator 50 through a condenser (not shown), an expansion unit (not shown), and an evaporator (not shown).

While flowing along the branch oil collection pipes 41, 42, and 43, the oil reduces in pressure and temperature at the capillaries 44, 45, and 46. Then, streams of the oil gather at the common oil collection pipe 40.

Thereafter, the gathered oil flows to the common inlet pipe 30 where the oil is distributed to the branch inlet pipes 31, 32, and 33 together with the refrigerant.

Here, the amounts of the refrigerant and the oil distributed from the common inlet pipe 30 to the branch inlet pipes 31, 32, and 33 are proportional to the capacities of the compressors 11, 12, and 13. That is, the branch inlet pipe 31 may receive the largest amount of refrigerant and oil.

According to the this embodiment, streams of oil discharged from the respective oil separators 21, 22, and 23 are combined at the common oil collection pipe 40, and then the oil is distributed to the compressors 11, 12, and 13. Therefore, the compressors 11, 12, and 13 may be prevented from malfunctioning caused by insufficient oil, and the oil levels of the compressors 11, 12, and 13 may be properly maintained.

Although an oil separator for a compressor having the lowest capacity may have a low oil separating rate (for example, the third compressor 13), a sufficient amount of oil may be supplied to the third compressor 13 from the common oil collection pipe 40. Therefore, the oil level of the third compressor 13 may be properly maintained.

For example, the compressors 11, 12, and 13 may be high-pressure compressors, and one of the compressors 11, 12, and 13 may store an extremely large amount of oil while the others may have insufficient oil. However, even in this case, the oil may be discharged from the compressor since a rotor of the compressor is placed in the oil.

The discharged oil may be distributed to all the compressors 11, 12, and 13 through the common oil collection pipe 40. Therefore, the compressors having insufficient oil may be supplied with the discharged oil and oil insufficiency is prevented.

Figure 2:
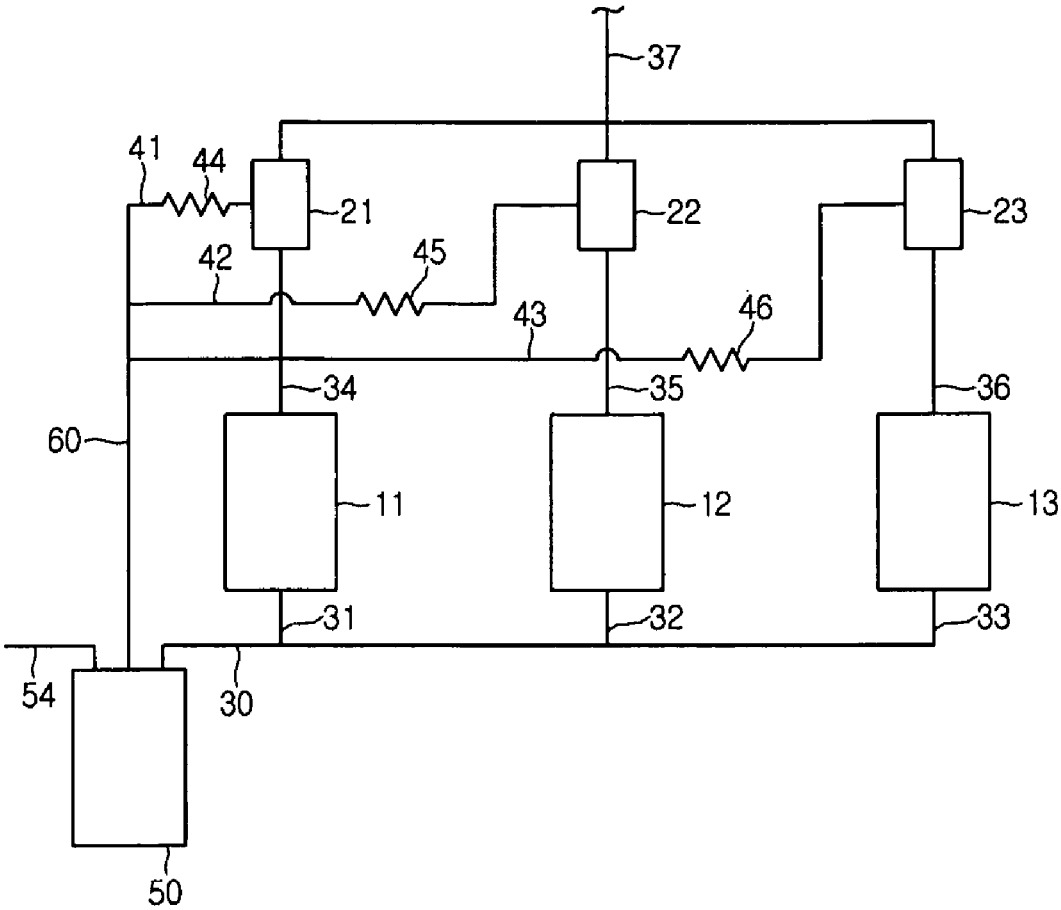
FIG. 2 is a partial refrigerant cycle diagram of an air conditioner according to a second embodiment.
Figure 3:
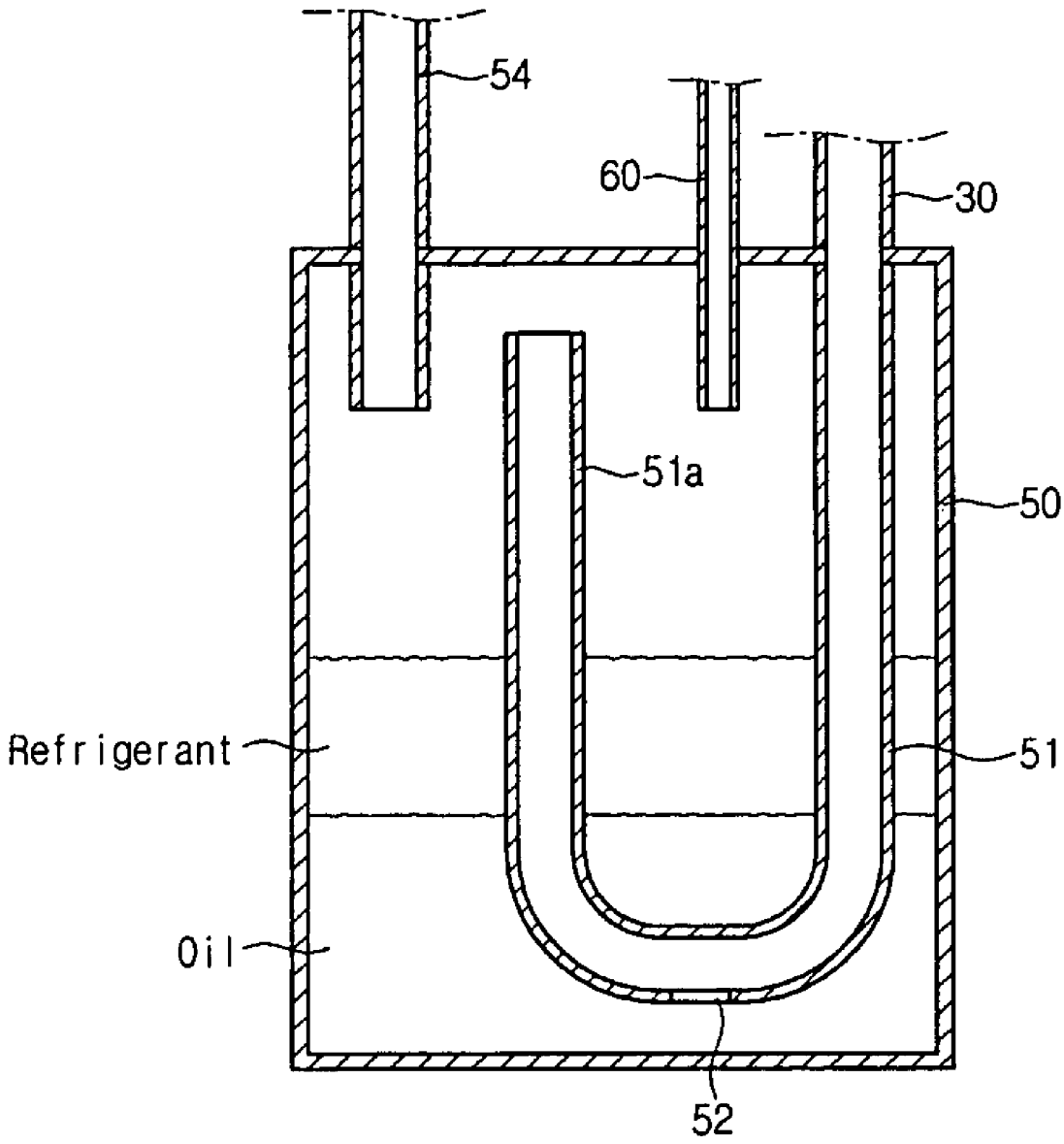
FIG. 3 is a sectional diagram schematically illustrating an accumulator of the air conditioner depicted in FIG. 2.

FIG. 2 is a partial refrigerant cycle diagram of an air conditioner according to a second embodiment, and FIG. 3 is a sectional diagram schematically illustrating an accumulator of the air conditioner depicted in FIG. 2.

The air conditioner of the second embodiment may have the same or similar structure as the air conditioner of the first embodiment except for a connection position of a common oil collection pipe. In the following description of the second embodiment, only the difference will be explained, and the same or similar structure will not be described.

In the embodiment of FIG. 2, a common oil connection pipe 60 is connected to an accumulator 50. Therefore, oil introduced into the accumulator 50 from the common oil connection pipe 60 may flow to a common inlet pipe 30 together with oil accumulated in the accumulator 50.

The oil accumulated in the accumulator 50 may be oil that was discharged from an evaporator to the accumulator 50. In other words, oil that was not separated by the oil separators 21, 22, and 23 passes through a condenser, an expansion unit, and a evaporator together with refrigerant, and then is introduced into the accumulator 50.

The accumulator 50 separates gas and liquid portions of the refrigerant and usually allows only the gas refrigerant to flow to the compressors 11, 12, and 13. In detail, a U-shaped gas refrigerant pipe 51 is disposed in the accumulator 50. The gas refrigerant pipe 51 communicates with the common inlet pipe 30.

A connection pipe 54 is connected to the accumulator 50 to supply the refrigerant discharged from the evaporator to the accumulator 50. Therefore, when the refrigerant is introduced into the accumulator 50, the gas portion of the refrigerant flows to the gas refrigerant pipe 51 through an inlet 51*a* of the gas refrigerant pipe 51. The liquid portion of the refrigerant flows to a lower portion of the accumulator 50 to be accumulated there.

An oil hole 52 may be formed at a lower portion of the gas refrigerant pipe 51 such that oil accumulated in the accumulator 50 may flow into the gas refrigerant pipe 51.

As shown in FIG. 3, in the accumulator 50, the liquid refrigerant accumulates on top of the oil because the liquid refrigerant is lighter than oil.

The temperature of the Oil introduced into the accumulator 50 from the common oil connection pipe 60 is usually higher than that of the liquid refrigerant and the oil accumulated in the accumulator 50, and thus the oil from the common oil connection pipe 60 is cooled.

High-temperature oil collected from the compressors 11, 12, and 13 may be first cooled by capillaries 44, 45, and 46 and secondly cooled in the accumulator 50. In this case, the gas refrigerant may be prevented from being heated by the separated oil in the accumulator 50.

Therefore, the compressors 11, 12, and 13 may have higher efficiencies since the gas refrigerant to be supplied to the compressors 11, 12, and 13 is not heated by the separated oil in the accumulator 50.

In this embodiment, the accumulator 50 is used to separate liquid and gas portions of a refrigerant. In addition, the accumulator 50 may decrease the temperature of oil collected from the compressors 11, 12, and 13 by allowing heat exchange between the collected oil and oil and/or refrigerant accumulated in the accumulator 50.

In this embodiment, the oil hole 52 is formed at the gas refrigerant pipe 51 to allow oil to flow from the accumulator 50 to the compressors 11, 12, and 13 through the gas refrigerant pipe 51.

Instead of forming the oil hole 52, an oil pipe may be connected from a lower portion of the accumulator 50 to the common inlet pipe 30 to allow oil to flow from the accumulator 50 to the compressors 11, 12, and 13 through the oil pipe and the common inlet pipe 30. In this case, a valve may be disposed at the oil pipe to control the flow rate of the oil.

In this embodiment, the common oil connection pipe 60 is connected to the accumulator 50. However, the common oil connection pipe 60 may be connected directly to the connection pipe 54 where refrigerant discharged from the evaporator flows.

Figure 4:
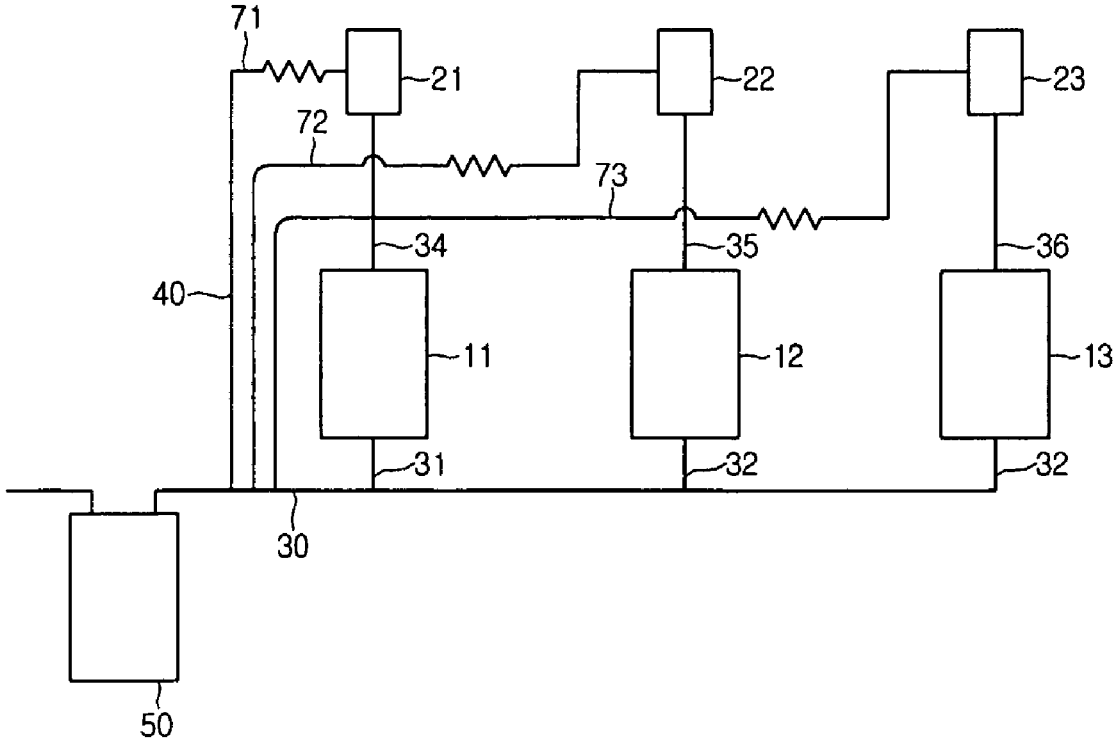
FIG. 4 is a partial refrigerant cycle diagram of an air conditioner according to a third embodiment.

FIG. 4 is a partial refrigerant cycle diagram of an air conditioner according to a third embodiment.

The air conditioner of the third embodiment may have the same or similar structure as the air conditioner of the first embodiment except for the structure of branch oil collection pipes. In the following description of the third embodiment, only the difference will be explained, and the same or similar structure will not be described.

Referring to FIG. 4, ends of first to third branch oil collection pipes 71, 72, and 73 are connected to oil separators 21, 22, and 23, and the other ends of the first to third branch oil collection pipes 71, 72, and 73 are connected to a common inlet pipe 30. Therefore, streams of oil from the branch oil collection pipes 71, 72, and 73 may gather at the common inlet pipe 30. According to this embodiment, a common oil collection pipe is not used.

In this embodiment, the branch oil collection pipes 71, 72, and 73 are directly connected to the common inlet pipe 30. However, the branch oil collection pipes 71, 72, and 73 may be connected to an accumulator 50 or a connection pipe 54.

According to the embodiments, streams of oil separated by the oil separators are combined and then are distributed to the respective compressors so that the oil levels of the compressors may be properly maintained, and oil insufficiency of the compressors may be prevented.

Furthermore, the combined streams of the separated oil may be introduced into the accumulator and their temperature decreased by the low-temperature liquid refrigerant accumulated in the accumulator. Therefore, the low-temperature gas refrigerant being heated by the oil may be prevented.

According to the embodiments, the oil levels of the plurality of compressors of the air conditioner may be uniformly maintained, and insufficient oil in the compressor may be prevented. Therefore, the air conditioner may be applied to various industrial fields.

Any reference in this specification to "one embodiment," "an embodiment," "exemplary embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with others of the embodiments.

Although embodiments have been described with reference to a number of illustrative embodiments thereof, it should be understood that numerous other modifications and embodiments can be devised by those skilled in the art that will fall within the spirit and scope of the principles of the invention. More particularly, various variations and modifications are possible in the component parts and/or arrangements of the subject combination arrangement within the scope of the disclosure, the drawings and the appended claims. In addition to variations and modifications in the components parts and/or arrangements, alternative uses will also be apparent to those skilled in the art.

What is claimed is:

1. An air conditioner comprising:

a plurality of compressors having different capacities;

a plurality of oil separators connected to respective outlets of the compressors to separate oil from refrigerant discharged from the compressors;

a plurality of oil collection pipes respectively connected to the oil separators to collect oil separated by the oil separators, wherein the oil collection pipes comprise capillaries, respectively, to reduce pressure of oil, wherein the capillaries have different diameters corresponding to the capacities of the compressors such that the diameter of a capillary corresponding to a high-capacity compressor is larger than that of a capillary corresponding to a low-capacity compressor;

a common inlet pipe to receive oil separated by the oil separators and to receive refrigerant and to allow the oil and refrigerant to flow to the compressors;

a plurality of branch inlet pipes branching off from the common inlet pipe and respectively connected to the compressors;

a common oil collection pipe at which streams of oil from the oil collection pipes gather; and an accumulator connected to the common inlet pipe to separate liquid and gas portions of the refrigerant, wherein the plurality of oil collection pipes are connected to the common oil collection pipe and the common oil collection pipe being directly connected to the common inlet pipe.

2. An air conditioner comprising:

a plurality of compressors having different capacities;

a common inlet pipe through which oil and refrigerant flows to the compressors;

branch inlet pipes branching off from the common inlet pipe and connected to the compressors;

a plurality of oil separators connected to outlets of the compressors to separate oil from the refrigerant discharged from the compressors;

an accumulator connected to the common inlet pipe to separate liquid and gas portions of the refrigerant; and a plurality oil collection pipes respectively connected to the oil separators to collect oil separated by the oil separators a common oil collection pipe at which streams of oil of the plurality of oil collection pipes gather, wherein the plurality of oil collection pipes are connected to the common oil collection pipe and the common oil collection pipe being directly connected to the common inlet pipe.

3. The air conditioner according to claim 1, wherein the accumulator includes:

an inlet to receive the refrigerant flowing to the common inlet pipe; and an outlet to receive at least a gas portion of the refrigerant and at least a portion of the oil, and to allow the at least the gas portion of the refrigerant and the portion of the oil to flow to the common inlet pipe.

4. An air conditioner comprising:

a plurality of compressors;

a common inlet pipe through which oil and refrigerant flows to the compressors;

branch inlet pipes branching off from the common inlet pipe and connected to the compressors;

an accumulator connected to the common inlet pipe, the accumulator allowing a gas portion of the refrigerant to flow to the common inlet pipe;

a plurality of oil separators connected to outlets of the compressors to separate oil from the refrigerant discharged from the compressors; and a plurality of oil collection pipes respectively connected to the oil separators to collect oil separated by the oil separators a common oil collection pipe at which streams of oil from the oil collection pipes gather, wherein the plurality of oil collection pipes are connected to the common oil collection pipe and the common oil collection pipe are directly connected to the common inlet pipe.

5. The air conditioner according to claim 3, wherein the accumulator accumulates at least a liquid portion of the refrigerant.

* * * * *